United States Patent [19]

Snaddon et al.

[11] Patent Number: 4,654,054

[45] Date of Patent: Mar. 31, 1987

[54] APPARATUS FOR REMOVING RESPIRABLE AEROSOLS FROM AIR

[75] Inventors: Robert W. L. Snaddon, Burnt Hills; Peter W. Dietz, Delanson, both of N.Y.

[73] Assignee: Black & Decker, Inc., Newark, Del.

[21] Appl. No.: 724,466

[22] Filed: Apr. 18, 1985

Related U.S. Application Data

[62] Division of Ser. No. 429,764, Sep. 30, 1982, Pat. No. 4,533,368.

[51] Int. Cl.[4] ..... B03C 3/12; B03C 3/41; B03C 3/82

[52] U.S. Cl. ..... 55/131; 55/137; 55/138; 55/152; 55/155

[58] Field of Search ..... 55/131, 137, 138, 150, 55/151, 152, 155

[56] References Cited

U.S. PATENT DOCUMENTS

| | | | |
|---|---|---|---|
| 2,990,912 | 7/1961 | Cole | 55/138 X |
| 2,992,700 | 7/1961 | Silverman et al. | 55/103 X |
| 3,108,865 | 10/1963 | Berly | 55/131 |
| 3,533,222 | 10/1970 | Gasperini | 55/152 X |
| 4,279,625 | 7/1981 | Inculet et al. | 55/131 |
| 4,354,858 | 10/1982 | Kumar et al. | 55/131 X |

*Primary Examiner*—Kathleen J. Prunner

*Attorney, Agent, or Firm*—Finnegan, Henderson, Farabow, Garrett & Dunner

[57] ABSTRACT

An apparatus for removing respirable aerosols (typically within the size range of about 0.1 to about 2 microns in diameter) from air comprises a housing and a chamber removably coupled to the housing so as to extend outwardly therefrom. The chamber contains a dielectric granular material forming a packed bed within a charged bed region and an apparatus spaced from the bed region for charging the aerosols in the air so that they may be removed when contacting the dielectric material in the bed region. The granular material is retained between two spaced apart gas permeable electrodes disposed adjacent an outlet end of the chamber and the charging apparatus is disposed adjacent the inlet end and is defined by a gas permeable support member having charging electrodes supported thereon or formed as an integral part thereof.

8 Claims, 11 Drawing Figures

APPARATUS FOR REMOVING RESPIRABLE AEROSOLS FROM AIR

This is a division of application Ser. No. 429,764, filed Sept. 30, 1982, now U.S. Pat. No. 4,533,368.

BACKGROUND OF THE INVENTION

This invention relates to an apparatus and method for conditioning air and more particularly to an apparatus and method for removing respirable aerosols, such as tobacco smoke, from air. Air conditioning includes controlling the temperature humidity, motion and cleanliness of the air.

Tobacco smoke is often a source of great discomfort to non-smokers. While health hazards of smoke are known, in a home office or living space the smoke has the further detrimental effect of causing discoloration of furnishings, fabrics and painted surfaces which may irreparable. In the winter these problems may be aggravated by the fact that good thermal insulation does not permit smoke concentrations to be diluted with fresh air from the outside.

Particles in the size range of about 0.1 to about 2 microns (μm) in diameter, hereinafter called respirable aerosols are preferentially deposited within the lungs when inhaled. An aerosol comprises a suspension of fine solid or liquid particles in a gas. For example, tobacco smoke particles are typically within this range. Unfortunately, particles in this size range are difficult to remove from air using conventional methods. These particles are generally too small for inertial mechanisms, e.g. direct impact filter, to be effective but too large for diffusion, e.g. Brownian movement, to play any significant role in their transport and removal. Sizes above about 2 μm can generally be removed readily from air using conventional methods such as uncharged fiber filters or an electrostatic precipitator having an electric field established between parallel plates between which the air is passed. Sizes below 0.1 μm tend to be exhaled and not to remain within the lung.

Thus it is desirable to have a means and method especially effective for the removal of respirable aerosols, such as tobacco smoke and dust particles from air.

Accordingly, it is an object of the present invention to provide an apparatus and method for removing respirable aerosols from air.

Another object of the present invention is to provide an apparatus and method for removing respirable aerosols from air wherein the apparatus is of small size and inexpensive to fabricate.

A further object of the present invention is to provide an apparatus and method, which are compatible with existing air conditioning systems, for removing respirable aerosols from air.

Still another object of the present invention is to provide an apparatus and method for electrostatically removing aerosols from air.

SUMMARY OF THE INVENTION

In accordance with the present invention an apparatus for removing respirable aerosols from air comprises a housing having a gas outlet, a chamber coupled to the housing, the chamber having retaining means disposed within the chamber dividing the chamber into gas-communicating charging and bed regions, wherein the charging region is in gas flow communication with the gas inlet and the bed region is in gas flow communication with the gas outlet, electrical means coupled to the housing for forming a corona discharge within the charging region and for forming an electrical field within the bed region, and electrical connecting means coupled to the electrical means for coupling the electrical means to a high voltage power supply.

Further, in accordance with the present invention a method for removing respirable aerosols from a gas comprises charging the aerosols in the gas, situating in an electric field a packed bed comprising a dielectric material, directing the gas containing the charged aerosols into the packed bed wherein the charged aerosols adhere to the dielectric material, and removing from the packed bed the gas being depleted in charged aerosols.

The features of the invention believed to be novel are set forth with particularity in the appended claims. The invention itself, however, both as to organization and method of operation, together with further objects and advantages thereof, may best be understood by reference to the detailed description taken in connection with the accompanying drawing.

DETAILED DESCRIPTION

Figure 1:
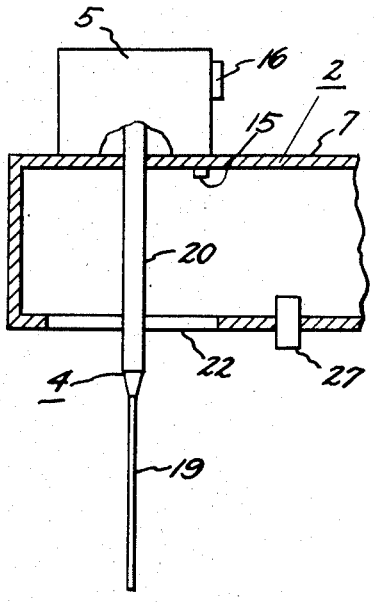
FIG. 1 is a partial sectional view of part of an apparatus for removing respirable aerosols from air fabricated in accordance with the present invention.
Figure 2:
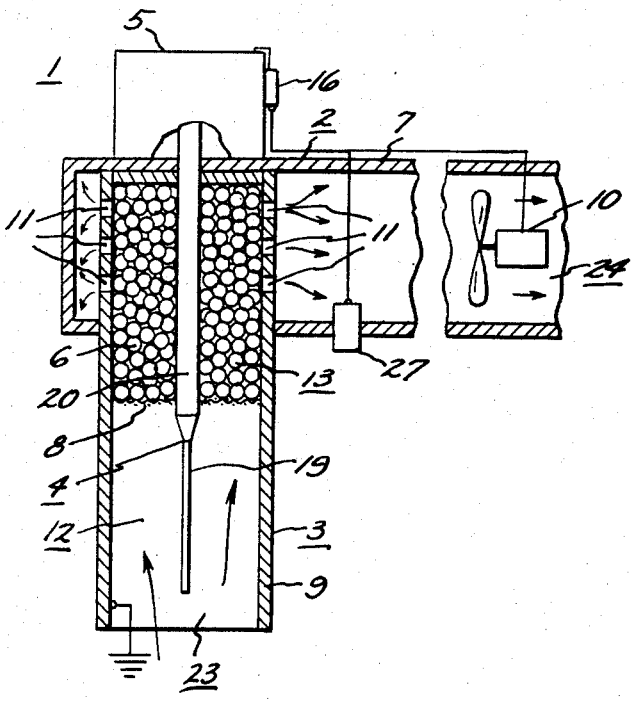
FIG. 2 is a partial sectional view of the apparatus of FIG. 1 with a demountable filter chamber in place for removing respirable aerosols from air, fabricated in accordance with the present invention.

Shown in FIGS. 1 and 2 are partial sectional views of an apparatus 1 for removing respirable aerosols from air. An aerosol comprises a suspension of fine solid or liquid particles in a gas. For purposes of the present discussion, respirable aerosols comprise material such as tobacco smoke, droplets, particles, dusts and pollens having a high probability of being retained in lung tissue once they have been inhaled and generally may be considered as having a diameter of about 0.1 to about 2 microns (μm). The present invention is especially adaptable to be used in living spaces, such as homes, offices and hospital rooms, although its use is not intended to be limited by such enumeration. Further, although especially well adapted to remove respirable aerosols, the present invention will also remove aerosols outside the respirable range. Additionally, although the present invention is described with respect to removing respirable aerosols from air, it is to be understood that it may also be used to remove aerosols from other gases as well. In all cases, the selection of material from the composition of the apparatus and of the dielectric material must be such as to avoid chemical interaction between the aerosols, gas, apparatus and dielectric material. However, such selection is capable of being per-formed by one skilled in the art without undue experimentation.

Referring to FIG. 2, apparatus 1 comprises a housing 2, a filter chamber 3, preferably cylindrical and preferably demountably affixed to housing 2, a charging means 4, such as an electrode, preferably substantially axially disposed within filter chamber 3 and a conventional high voltage power supply 5 affixed to housing 2 and electrically connected to electrode 4.

Housing 2 comprises a chamber or duct 7 having a gas outlet 24, a gas moving means 10, such as a fan, which may be disposed within duct 7 for providing a gas flow through duct 7 to outlet 24 thereof and a pressure sensing means or transducer 27, disposed through a wall of duct 7. Duct 7 may comprise an electrically conducting material although an insulating material such as a plastic is preferred. Pressure transducer 27, which may include a normally open single-pole, single throw diaphragm switch that closes a circuit to energize a lamp 16 when the pressure differential or drop across bed region 13 exceeds a predetermined threshold, is preferably disposed such that the differential pressure within duct 7 and the pressure of ambient air outside duct 7 is sensed.

Filter chamber 3, having a gas inlet 23 and a chamber gas outlet preferably including a plurality of orifices 11, comprises a gas permeable retainer means 8, such as a nonconducting screen, disposed within filter chamber 3, partitioning filter chamber 3 into a charging region 12 and a bed region 13. Granular dielectric material 6, such as polystyrene, preferably shaped as spheres or beads having a diameter of about 2–3 millimeters, is disposed within bed region 13 and retained therein by scree 8 having a mesh size sufficiently small to prevent material 6 from passing therethrough. Alternatively, fan 10 may be disposed at the inlet 23 to filter chamber 3.

Apertures 11 are provided through the wall or boundary 9 of filter chamber 3 in order to provide a chamber gas outlet and flow communication path between bed region 13 and duct 7 and are sized so as not to permit the transport of material 6 therethrough. The wall 9 of filter chamber 3 may comprise an insulating material, such as a plastic or cardboard, having a conductive inner surface 14 comprising a conductive material, such as metal, metal foil or conductive paint. The inner surface 14 of wall 9 is connected to ground potential.

Electrode 4, which may terminate within power supply 5 in order to facilitate electrical connections thereto, extends the entire length of the bed region 13 and charging region 12. Electrode 4 typically comprises a rod having a portion 20 thereof disposed within bed region 13 larger in diameter than a portion 19 thereof disposed within charging region 12. The transition from portion 20 to portion 19 occurs outside bed region 13 in order to ensure that a substantially uniform field is maintained within bed region 13. Electrode 4 is supplied with high voltage from high voltage power supply 5. When a D.C. high voltage supply is used, the high voltage may be of either polarity, however, a negative polarity generally provides a better corona discharge. Alternatively, a high voltage AC power supply may be connected to electrode 4, in which case it is preferable to coat the surface of dielectric material 6 with a material, such as an antistatic agent, to assist conduction of electrons during the alternating cycles of the field and thereby avoid excessive charge build-up in material 6 as the field relaxes and then builds-up in the opposite direction.

Figure 6A:
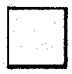
FIGS. 6A, 6B and 6C are cross-sectional views of embodiments of an electrode useful with an apparatus for removing respirable aerosols from air, fabricated in accordance with the present invention.
Figure 6B:
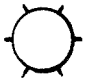
Figure 6C:
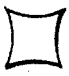
Figure 7:
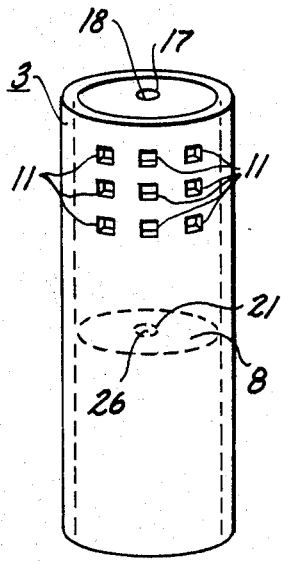
FIG. 7 is a perspective view of a demountable part of an apparatus fabricated in accordance with the present invention.
Figure 8:
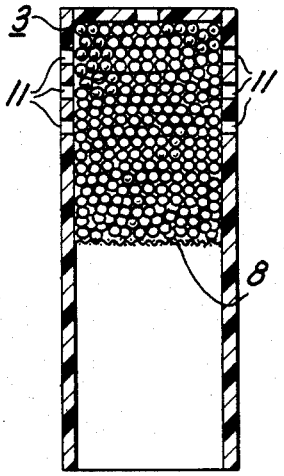
Figure 9:
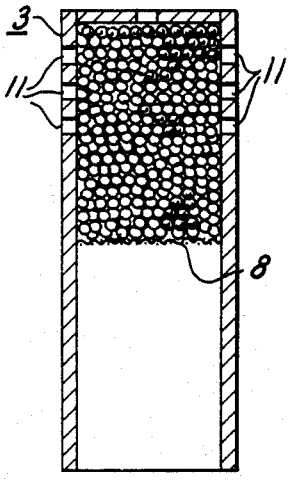

Portion 20 of electrode 4 is preferably cylindrical with a smooth outer surface. Portion 19 of electrode 4 may likewise be cylindrical, having a smaller diameter than portion 20 thereof. However, it is preferable to have sharp edges along the length of portion 19 of electrode 4 in order to ensure corona discharge along the entire length of portion 19. Thus portion 19 may comprise a rectangular prism having the cross-section of a rectangle or preferably a square as shown in FIG. 6A, a cylinder or rod having a plurality of protrusions such as fins longitudinally disposed on and radially extending from the outer surface thereof as shown in cross-section in FIG. 6B, or an elongated member having a plurality of cusps shown in cross-section in FIG. 6C. Of course many other configurations of portion 19 of electrode 4 will be readily apparent to one skilled in the art.

The electric field in the bed region 13, between portion 20 of electrode 4 and inner surface 14 of wall 9 will polarize dielectric material 6. Electrode 4, being preferably substantially axially disposed within filter chamber 3, produces a substantially uniform electrical field within bed region 13 and a non-uniform or divergent electrical field within charging region 12. The electrical field intensity in charging region 12 is increased toward the surface of portion 19 of electrode 4 due to the reduction in diameter thereof with respect to portion 20 of electrode 4 and/or the sharp edges along portion 19, thus distorting the uniformity of the electrical field in charging region 12. Since the charging of the respirable aerosols within charging region 12 is to be effected by a corona discharge, a divergent electrical field in region 12 is required.

Lamp 16 signifies when the dielectric material 6 has become so contaminated with respirable aerosols that it should be changed or cleaned. Lamp 16 may be responsive to the current in either the low voltage input or high voltage output of power supply 5, or to the power or current required by fan 10 to maintain a suitable gas flow from input 23 of charging region 12 to output 24 of duct 7 if it is desired to avoid use of pressure transducer 27 to sense the pressure drop from input 23 of charging region 12 to output 24 of duct 7. By monitoring the fan current or the pressure drop, the effect of humidity on the current from the high voltage supply 5 is avoided. Lamp 16 may be advantageously mounted on power supply 5 to facilitate electrical connections between lamp 16 and either the low voltage input or high voltage output of power supply 5.

An increase in the input or output current of power supply 5 is indicative of increased contamination of dielectric material 6 due to respirable aerosols adhering to the surfaces thereof. The increased contamination results in a decrease in resistivity of material 6. The pressure drop from input 23 of charging region 12 to output 24 of duct 7 will increase as respirable aerosols removed from the air adhere to the surfaces of dielectric material 6, thus decreasing the available flow volume through bed region 13. The current or power input to fan 10 will also increase, especially if a synchronous motor is used, as the available flow volume through bed region 13 decreases and the resistance to air flow therethrough increases causing an increased load on the motor. The threshold settings, dependent on the type of monitor and point for monitoring selected, above which lamp 16 will be activated and thereby signify the need to change or recharge dielectric material 6, may be readily established by one skilled in the art. When the contamination level exceeds a predetermined threshold, indicating that the filter is clogged, a bypass (not shown) may be opened to divert air around the filter and to allow air flow from the input to the output of the apparatus to continue until the filter is cleaned or changed.

Although chamber 3 having contaminated dielectric material 6 disposed therein has been described as capable of being discarded and replaced by another chamber 3 having non-contaminated dielectric material 6 disposed therein, thus effecting a relatively inexpensive and simple way of rejuvenating apparatus 1, it is to be understood that it is possible to replace the contaminated dielectric material 6, without discarding chamber 3. An access means (not shown), such as a slidable door may be provided to cover an orifice through wall 9 having a terminus within bed region 13. Alternatively, retainer 8 may be removably affixed to chamber 3 so that contaminated dielectric material 6 may be removed from bed region 13 and replaced with non-contaminated dielectric material 6.

Referring to FIG. 1, the housing 2 of FIG. 2 with the filter chamber 3 (FIG. 2) removed is shown. An opening 22 is provided in duct 7 in order to allow filter chamber 3 (FIG. 2) to form an air tight seal with housing 2. When properly mated and aligned with respect to housing 2, filter chamber 3 (FIG. 2) will engage mechanical interlock switch 15, thereby enabling high voltage to be provided to electrode 4.

Figure 3:
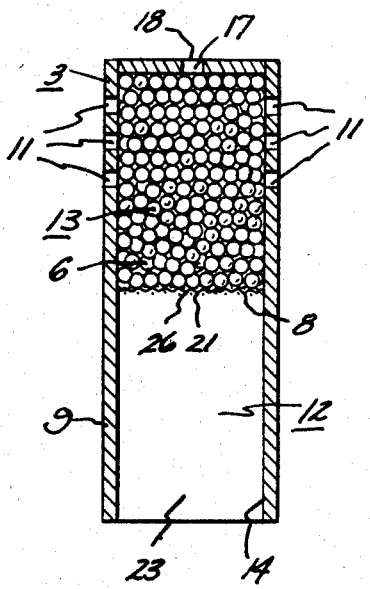
FIGS. 3, 4, 5, 8, and 9 are sectional views of other demountable parts of an apparatus for removing respirable aerosols from air, fabricated in accordance with the present invention.

Shown in FIG. 3 is a filter chamber 3 which may be used with the present invention. Electrode orifices 17 and 21 are provided through a wall of chamber 3 and retainer means 8 thereof, respectively, in registration, to accommodate electrode 4 (FIG. 2) when filter chamber 3 is coupled to housing 2 (FIG. 2). Rupturable coverings or sealing means 18 and 26, such as paper, over orifices 17 and 21, respectively, prevent material 6 from exiting bed region 13 before filter chamber 3 and electrode 4 are mated with housing 2 (FIG. 2). Filter chamber 3 may be comprised as hereinbefore described and may be made disposable such that when the dielectric material 6 thereof is sufficiently contaminated, the old filter chamber 3 is removed from housing 2 (FIG. 1) and a new one is put in its place. The choice of cardboard or plastic for the material of chamber 3 and metal foil or conductive paint for inner surface 14 thereof makes chamber 3 rather inexpensive and therefore feasible to dispose. Apertures 11 of filter chamber 3 constitute the gas outlet of chamber 3.

Alternatively, a tube or ferrule 28 (FIG. 4) internally sized to receive electrode 4 such that electrode 4 is coaxial therewith during operation may be disposed within bed region 13 and affixed to retainer means 8 and chamber 3 such that the space or volume defined by the internal wall of ferrule 28 forms a communicating path between electrode orifices 17 and 21. Ferrule 28 may comprise a conductive material or may comprise cardboard or a plastic having both the inner and outer walls or surfaces thereof coated with a conducting material such as metal foil or conductive paint as hereinbefore described. Ferrule 28 prevents material 6 from interfering with the insertion of electrode 4 through bed region 13.

Figure 4:
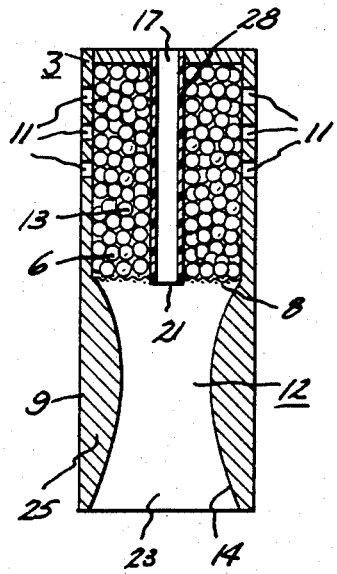

Also shown in FIG. 4 is another configuration of a filter chamber 3 fabricated in accordance with the present invention. The wall or diametrically opposed margins 25 of filter chamber 3 defining the charging region 12 are extended inwardly so that opposing portions of the wall surface are closer together, being closest at the central portion of charging region 12, thus reducing the radial size of charging region 12 and effecting a more intense field in charging region 12. The contour of the wall surface 25 is smooth to permit the even flow of air through charging region 12.

Figure 5:
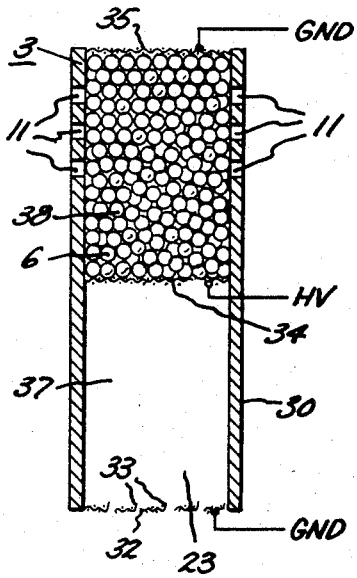

Shown in FIG. 5 is another configuration of a filter chamber 3 fabricated in accordance with the present invention. When the filter chamber configuration shown in FIG. 5 is used, the electrode 4 of FIG. 1 may be omitted from the housing 2. Filter chamber 3 having an input 23 at one end, comprises a wall 30, preferably cylindrical having a plurality of orifices 11 located toward the other end of filter chamber 3, a support member 32 disposed across the input 23, a first electrode 34 disposed within filter chamber 3 and spaced from support member 32 to form a charging region 37 therebetween and a second electrode 35 disposed within filter chamber 3 and spaced from first electrode 34 to form a bed region 38 therebetween. Dielectric material 6, such as hereinbefore described, is disposed within bed region 38.

First electrode 34 and support member 32 are gas permeable, offering minimum resistance to gas flow therethrough. First and second electrodes 34 and 35 comprise a conductive material such as a screen or mesh and are connected to a high voltage and ground potential, respectively.

Charging electrode 33 may be supported by, or preferably be an integral part of,support member 32. Support member 32 may comprise an insulating material such as a plastic, or preferably comprise a conductive material formed into a mesh or screen and, in any case, offering relatively little resistance to gas flow therethrough. When support member 32 comprises a conductive material, charging electrodes 33 may be fabricated as an integral part thereof by cutting the screen of support member 32 at predetermined intervals to form ends and bending the cut portions such that they are substantially perpendicular to support member 32 having the ends pointing toward first electrode 34. Charging electrodes 33 are spaced from each other to provide a good ion density therebetween. That is, the ion density per unit volume should be sufficient to charge all aerosols passing therethrough. If charging electrodes 33 are too close to one another, they will interfere with each other and there will be no corona discharge to supply ions between charging electrodes 33 and first electrode 34. If charging electrodes 33 are too far apart, there will exist gaps or volumes of low ion density resulting in incomplete charging of aerosols passing electrodes 33.

Charging electrodes 33 are spaced from first electrode 34 to provide a uniform corona discharge therebetween. Preferably the corona discharge gradient i.e. volts per unit distance, is maximized without causing breakdown. Likewise, the spacing between first electrode 34 and second electrode 35 is selected to maximize the electric field therebetween without causing electric breakdown or arcing, thus subjecting bed region 38 and dielectric material 6 contained therein to maximum electric field intensity and thereby obtaining maximum filtering efficiency for a given air flow velocity through the filter.

When charging electrodes 33 comprise an integral part of support member 32 and support member 32 comprises a conductive material, support member 32 is connected to ground potential, thus establishing charging electrodes 33 at ground potential also. If support member 32 comprises an insulating material, then charging electrodes 33 comprise a conducting material and are each connected to ground potential. The point-planar charging configuration established by charging electrodes 33 and first electrode 34 generally requires a smaller amount of current in order to maintain an adequate corona discharge than do configurations, such as shown in FIG. 1, using a central electrode.

With any filter chamber 3 used with the present invention, positive retention means (not shown), such as a key which engages a mating slot or member and is secured upon rotation of filter chamber 3 may be provided on the portion of housing 2 (FIG. 2) which abuts filter chamber 3. This retention means ensures that cooperation between housing 2 and filter chamber 3 is maintained under adverse conditions such as vibration.

Thus has been shown and described an apparatus and method especially effective for removing respirable aerosols from air. The apparatus may be readily renewed after being contaminated by the aerosols removed from the air and signaling means is provided to indicate when the apparatus should be renewed.

While only certain preferred features of the invention have been shown by way of illustration, many modifications and changes will occur to those skilled in the art. It is to be understood that the appended claims are intended to cover all such modifications and changes as fall within the true spirit and scope of the invention.

What is claimed is:

1. An apparatus for removing respirable aerosols from a gas comprising:

(a) a housing having a housing gas outlet and a housing gas inlet;

(b) a chamber removably coupled to said housing at the housing gas inlet, said chamber having two end regions and a side wall extending between the two end regions, a chamber gas inlet at one end region for introducing gas and aerosols for axial flow through the chamber, said one end region extending outside of the housing when coupled to the housing, a chamber gas outlet located on said side wall at the other end region and positioned inside of the housing when coupled to the housing for directing a transverse flow of gas out of the chamber and into the housing, said transverse flow being generally perpendicular to the axial flow through the chamber, a charging region situated adjacent said chamber gas inlet and including means for charging the aerosols in the charging region, a bed region situated adjacent said chamber gas outlet and including dielectric material through which gas from said charging region is passed, so that said aerosols are charged in the charging region and deposited on the surface of said material in the bed region;

(c) first and second electrodes disposed within said chamber and spaced from each other by said dielectric material, said first electrode situated upstream of said second electrode; and (d) a support member disposed within said charging region wherein said charging means includes a plurality of charging electrodes supported within said chamber by said support member, said charging electrodes situated upstream of said first electrode and spaced from said first electrode to provide a uniform corona discharge between the charging electrodes and the first electrode.

2. The apparatus of claim 1 wherein said dielectric material is granular and disposed within said bed region forming a packed bed therein.

3. The apparatus of claim 2 wherein said granular material comprises polystyrene.

4. The apparatus of claim 1 wherein said support member comprises a conductive screen and said charging electrodes comprise an integral part of said screen.

5. The apparatus of claim 4 wherein the screen is generally planar and is interrupted at predetermined intervals to form longitudinally extending end portions at said intervals, said end portions comprising said charging electrodes.

6. The apparatus of claim 5 wherein the longitudinally extending end portions extend generally perpendicular to the plane of the screen.

7. The apparatus of claim 5 wherein the longitudinally extending end portions extend generally toward said first electrode.

8. An apparatus for removing respirable aerosols from a gas comprising:

(a) a housing having a housing gas outlet and a housing gas inlet; and (b) a chamber removably coupled to said housing at the housing gas inlet, said chamber having two end regions and a side wall extending between the two end regions, a chamber gas inlet at one end region for introducing gas and aerosols for axial flow through the chamber, said one end region extending outside of the housing when coupling to the housing, a chamber gas outlet located on said side wall at the other end region and positioned inside of the housing when coupled to the housing for directing a transverse flow of gas out of the chamber and into the housing, said transverse flow being generally perpendicular to the axial flow through the chamber, retaining means disposed within said chamber for dividing said chamber into gas-communicating charging and bed regions, said charging region situated between said retaining means and said chamber gas inlet and including means for charging the aerosols in the charging region, said bed region situated between said retaining means and said chamber gas outlet and including dielectric material through which gas from said charging region is passed, so that said aerosols are charged in the charging region and deposited on the surface of said material in the bed region.

* * * * *